United States Patent [19]

Abrams

[11] Patent Number: 4,519,765

[45] Date of Patent: May 28, 1985

[54] MOLD

[76] Inventor: Charles F. Abrams, 4311 Lemp Ave., Studio City, Calif. 91604

[21] Appl. No.: 545,921

[22] Filed: Oct. 27, 1983

[51] Int. Cl.[3] ..... B28B 1/02; B28C 1/00

[52] U.S. Cl. ..... 425/263; 249/134

[58] Field of Search ..... 425/263–268

[56] References Cited

U.S. PATENT DOCUMENTS

| | | | |
|---|---|---|---|
| 579,755 | 3/1897 | Knapp | 425/264 |
| 2,584,110 | 2/1952 | Blackburn et al. | 425/268 |
| 4,286,938 | 9/1981 | Ryckman | 425/265 |

FOREIGN PATENT DOCUMENTS

| | | | |
|---|---|---|---|
| 2116111 | 10/1972 | Fed. Rep. of Germany | 425/263 |

*Primary Examiner*—Willard E. Hoag

*Attorney, Agent, or Firm*—Blakely, Sokoloff, Taylor & Zafman

[57] ABSTRACT

An improved mold is provided having an abrasion-resistant reinforcing means disposed at the junction between the mold and a rotating means for resisting wear occurring therebetween as a result of the installation of the mold on a rotating wheel. Preferably, the reinforcing means comprises a hardened plastic ring having a smooth surface facing the drive wheel, and the ring is partially embedded into the mold to attach it to said mold.

18 Claims, 5 Drawing Figures

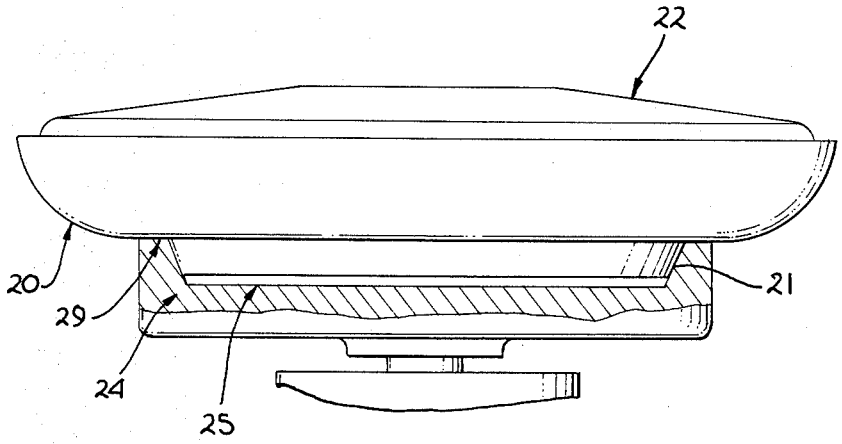
Fig. 1
Fig. 2
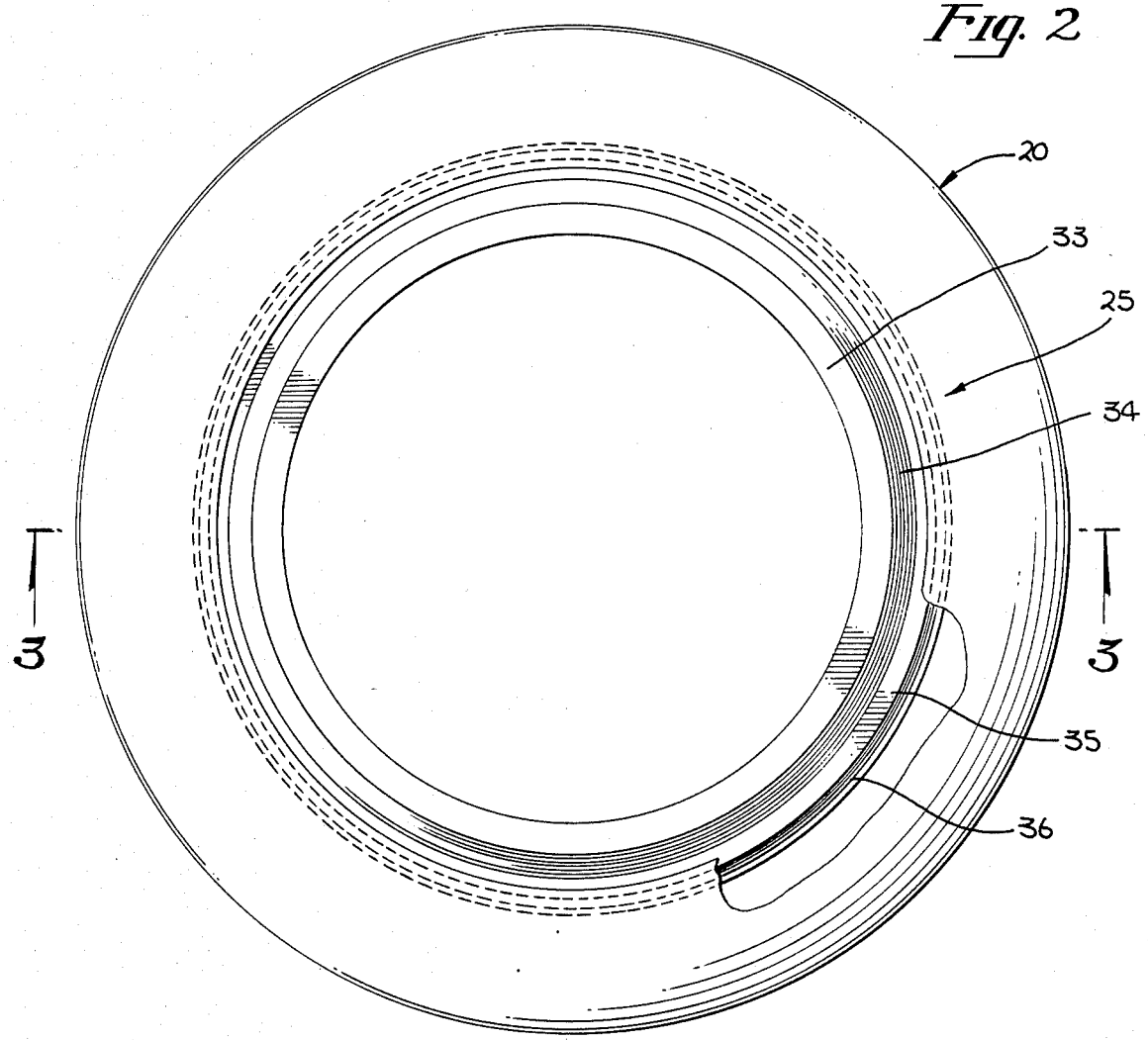

MOLD

FIELD OF THE INVENTION

The present invention relates to an improved mold for forming clay or the like into ceramic articles. In particular, the invention is directed to an improved mold with a reinforced surface adapted to engage the rotating means of a jigger machine.

BACKGROUND OF THE INVENTION

A typical apparatus for the manufacture of ceramic ware comprises a jigger having a rotating means on which a bottom mold is disposed and an arm thereabove having a top mold attached thereto. Ceramic ware articles are formed between the bottom mold and the top mold.

The jigger machines are of two types, those on which the rotating means is halted after each article is formed, thereby allowing the bottom mold to be installed thereon, and those on which the rotating means rotates continuously without halting, so that the bottom mold must be removed from and installed on the rotating means while it is rotating. For both types of jigger machines, there is a problem with the longevity of the bottom mold, which is better understood with reference to the process for manufacturing cermaic ware. For clarification, as used herein, the term "bottom mold" refers to the mold rotated on the jigger rotating means, and not to whether the rotating mold forms the top or bottom surface of the ceramic ware article. Similarly, the term "top mold" refers to the mold disposed on the arm of the jigger machine, and not to which surface of a ceramic article is formed therewith.

In the first step of the manufacture of ceramic plates and the like, potter's clay is placed on the bottom mold, either while the mold is rotating or while it is stationary, depending upon the type of jigger. The top mold is placed over the potters clay, thereby pressing the clay between the top and bottom molds. The bottom mold is then rotated at a predetermined speed, or it continues to rotate at such speed, and the clay is formed into the desired shape.

The thickness of the ceramic article is determined by the distance between the bottom mold and top mold after the spinning step on the jigger is completed. Typically, the arm bearing said top mold is lowered towards the bottom mold to a predetermined position which is independent of the height of the bottom mold. Therefore, if the vertical position of the bottom mold changes, the thickness of the ceramic articles will correspondingly change. Such changes in the vertical position of the bottom mold can be explained as follows.

The bottom mold is generally made from a plaster material which has specific desirable physical characteristics that allow the mold to interact with the clay in a particular way. Thus, it is necessary for the mold surface contacting the clay to be made of a plaster material. Conversely, the rotating means, which engages the layer surface of said bottom mold, is generally formed of metal. Thus, when said bottom mold is placed on the rotating means while it is rotating, or is removed therefrom, wear occurs at the junction at which said bottom mold engages said rotating means. Similarly, for the type of jigger which halts its rotation so that the mold can be installed or removed, therefrom, when the rotating means is rapidly accelerated to a predetermined speed, until said bottom mold achieves the same velocity as said rotating means, wear occurs at the junction at which said bottom mold engages said rotating means. This wear results in the cutting of a groove in the mold at the surface which engages the rotating means. As the depth of the groove increases, the height of the bottom mold decreases. Correspondingly, since the vertical position of the top mold is preset, the size of the gap between the top and bottom molds increases, and consequently, the thickness of the ceramic ware article formed therebetween increases.

Therefore, it becomes necessary to replace said bottom mold with relative frequency, in order to keep the thickness of ceramic ware formed by this process within predefined tolerances. Such frequent mold replacement has the obvious consequence of increasing the manufacturing costs of ceramic ware. The present invention solves this problem of frequent mold replacement.

Moreover, it is also important in producing uniformly shaped ceramic ware, that the mold rotate substantially circularly. If the mold rotates off-center, or is wobbling about its axis of rotation, the clay thereon will be lopsided, and an irregularly shaped article will be formed. This wobble may be caused by excessive wear on the positioning stem of the bottom mold which seats in the rotating means due to friction between said mold and said rotating means. The present invention also solves the aforementioned problem.

SUMMARY OF THE INVENTION

The present invention is an improved ceramic ware mold having greater useful life than the prior art plaster molds, said mold having an abrasion resistant material disposed at the junction between the mold and the rotating means of the jigger. The abrasion resistant material is preferably in the form of a plastic reinforcing ring which may be embedded in the bottom surface of said mold, or otherwise attached thereto. The ring preferably has a smooth surface for engaging the rotating means, thereby allowing slippage to occur between said mold and said drive wheel.

For the purpose of illustrating the present invention, there is shown in the drawings, a form which is presently preferred; it being understood, however, that this invention is not limited by the precise arrangement shown herein, but only by the scope of the appended claims.

DETAILED DESCRIPTION OF THE DRAWINGS

FIG. 1 is a side view of the invented mold with the rotating means partially cut away.

FIG. 2 is a bottom view of the invented mold with a portion of the bottom surface cut away.

DETAILED DESCRIPTION

Figure 3:
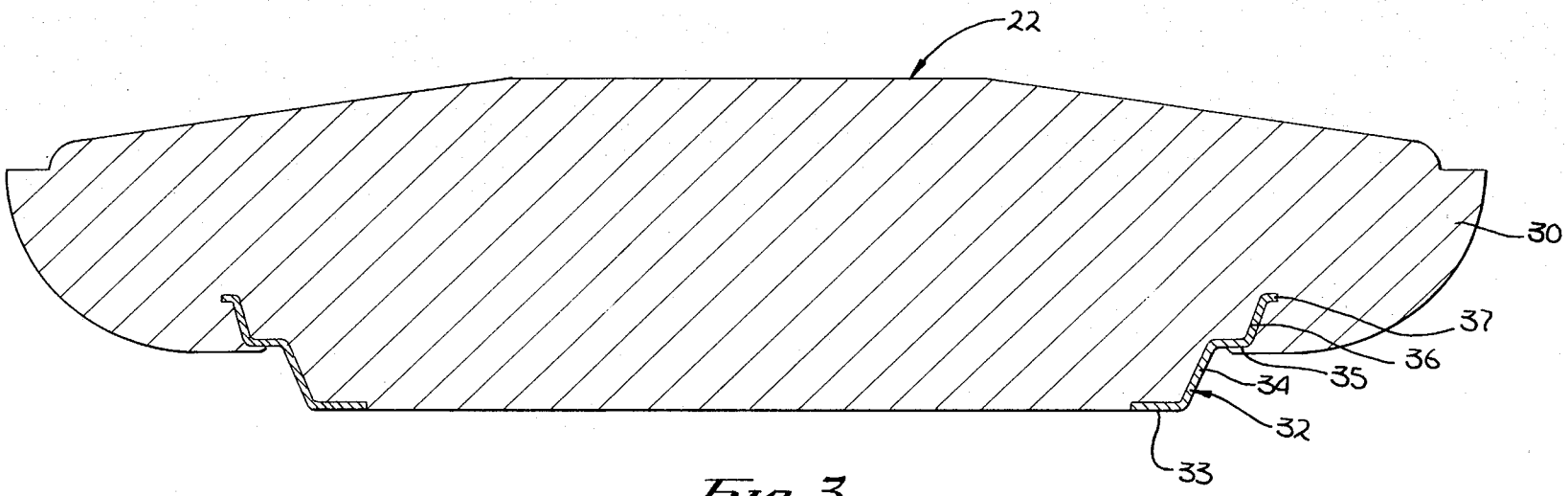
FIG. 3 is a sectional view of the invented mold taken through line 3—3 of FIG. 2.

Referring now to the drawings in detail, wherein like numerals indicate like elements, FIG. 1 shows generally the invented mold 20 disposed on a rotating means 24 of a jigger, said rotating means 24 being shown partially cut away so that the mold 20 can be viewed fully installed thereon.

The mold 20 is typically formed of a plaster material having an upper surface 22 on which clay is placed to be formed into a ceramic article, and a lower surface 25 adapted to receive the rotating means 24. The improvement to which the invention is directed is the addition of an abrasion resistant reinforcing member which prevents the cutting of an annular groove at primary critical junction 29 caused by the previously described friction between the mold 20 and rotating means 24. The invention, as disclosed herein, comprises at least one hardened plastic ring surface 35 disposed over junction 29, although other abrasion resistant materials, such as metal, wood, or a polymer can also be used.

On the one hand, it is important to provide junction 29 with improved resistance to abrasion. On the other hand, excess friction between the rotating means 24 and mold 20 will cause rapid wear of the reinforcing member, the rotating means, or both. It is preferable, therefore, for said reinforcing member to have a smooth surface which abuts the rotating means, thereby permitting some slippage to occur between the mold 20 and rotating means 24, until said mold attains the rotational velocity of said rotating means.

The reinforcing member 32 can be attached to said mold 30 by any attachment means which is well known in the art, including but not limited to, adhesive compositions, screws installed therethrough with the screw head recessed below the surface of the reinforcing means, flanges on said reinforcing means attached to a portion of the mold, or embedding a portion of said reinforcing means in the plaster mold. The securing means comprising embedding a portion of said reinforcing means in said plaster mold is the preferred embodiment, and is hereinafter described and illustrated in the drawings.

Figure 5:
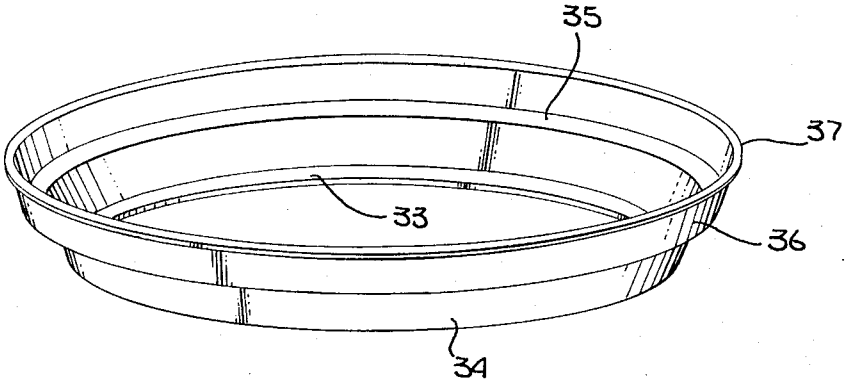
FIG. 5 is a perspective view of a reinforcing member.
Figure 4:
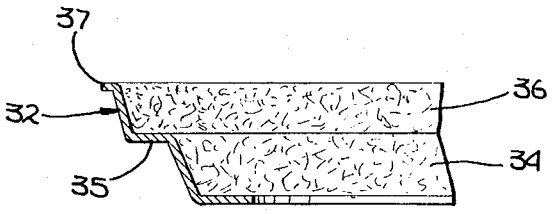
FIG. 4 is a side view of a portion of a reinforcing member.

The reinforcing member 32, as clearly shown in FIG. 5, comprises a group of rings attached to each other in a step-wise fashion. The innermost section 33 has a flat annular surface and is coplanar with the mold 20. The next section outward is an approximately vertical section 34, which is adapted to abut side 21 of the mold 20. Side 21 is used as a guide for installing mold 20 into the rotating means 24. Side 21 is a secondary critical junction because excessive wear occurring thereto as a result of misaligned installation of the mold 20 can result in lop-sided seating of the mold 20 in the rotating means 24. Such lop-sided seating, in turn, can result in the manufacture of irregularly shaped ceramic ware. The next ring outward is the previously discussed ring 35 which is disposed over the primary critical junction 29 of the mold which seats on the rotating means. The fourth 36 and fifth 37 rings are embedded in the plaster mold to secure said reinforcing means to said mold.

Using techniques presently known in the art, the reinforcing member may also be interchangeably attached to said mold such that when a reinforcing member is worn, it can be replaced with another reinforcing member, thereby further extending the life of the mold. For this embodiment, the screw attachment means or adhesive attachment means described above are preferred.

One problem with the disposition of a reinforcing material to the mold at the surface engaging the rotating means of the jigger is that said reinforcing material cannot cause a significant increase in the overall depth of the bottom mold, or else the ceramic ware formed thereon will be thinner than desired. This problem is due to the previously described arm of the jigger, being set to lower to a predetermined height independently of the height of said bottom mold. Therefore, converse to the problem of mold wear, any increase in the height of the bottom mold caused by the installation of the reinforcing member, results in the formation of a thinner, less durable ceramic ware article. This problem is overcome in the present invention by the embedding of the reinforcing material in the mold so that the overall thickness of the mold is not increased. In other embodiments of the present invention, such as where the reinforcing material is attached to the mold by an adhesive material, or otherwise, the mold can be formed thinner so that the overall thickness of the mold is substantially equivalent to prior art molds. Alternatively, the jigger arm height can be adjusted accordingly.

Other advantages and features, as well as modifications of the improved mold describe herein and within the scope of the present invention will be evident to those skilled in the art. Although the invention has been described with reference to the preferred embodiment, it is to be understood that variations and modifications apparent to those skilled in the art may be adopted without departing from the nature and scope of the claims appended hereto.

I claim:

1. An improved plaster mold having an increased useful life, said mold having a top surface for forming ceramic ware and a bottom surface for frictional engagement with jigger rotating means having a substantially horizontal ring-like upper surface; the improvement comprising an abrasion resistant ring of reinforcing material affixed to the bottom surface of said mold at the junction between said mold and said surface of said rotating means whereby said reinforcing material protects said mold at said junction thereby reducing wear thereto.

2. The mold of claim 1 wherein said reinforcing material is a hardened polymer.

3. The mold of claim 1 wherein said reinforcing material is a hardened plastic material formed into a ring-shape.

4. The mold of claim 3 wherein said plastic material further comprises a smooth exterior surface whereby said smooth surface slidably engages said rotating means when said mold is installed thereon, thereby reducing friction between said reinforcing material and said rotating means.

5. The mold of claim 1 wherein said reinforcing material comprises attachment means for attaching said reinforcing material to said mold.

6. The mold of claim 5 wherein said attachment means is embedded in said plaster mold.

7. The mold of claim 6 wherein said attachment means is reversible without substantial destruction to said mold whereby said reinforcing material installed on said mold can be replaced.

8. The mold of claim 1 wherein said reinforcing material is a metal.

9. The mold of claim 8 wherein said reinforcing means comprises an abrasion resistant material.

10. The mold of claim 9 wherein said abrasion resistant material is hardened plastic.

11. A mold for forming ceramic ware comprising: a plaster mold having an upper surface for forming ceramic ware and a lower surface including a truncated conical receiving surface for receiving a means for rotating said mold, and a reinforcing ring disposed on said lower surface, between said rotating means and said receiving surface, said ring being positioned radially outwardly of said conical receiving surface.

12. The mold of claim 11 wherein said reinforcing means comprises a ring formed of plastic.

13. The mold of claim 11 wherein said reinforcing means is interchangeable without substantial destruction to said mold.

14. A mold for forming ceramic ware and the like comprising a plaster mold having an upper surface for forming said ceramic ware, and a lower surface for receiving a rotating means, wherein the improvement comprises a ring-like member disposed on said lower surface, said ring-like member having a first portion attached to said lower surface by an attachment means, and an abrasion resistant second portion attached to said first portion and disposed in the junction between said mold and said rotating means.

15. The mold of claim 14 wherein said ring-like member is formed of plastic.

16. The mold of claim 14 wherein said attachment means comprises embedding said first portion in said plaster mold.

17. The mold of claim 14 wherein said attachment means comprises adhesive material.

18. The mold of claim 14 wherein said second portion has a smooth surface for abutting said rotating means.

* * * * *